US006585415B2

(12) United States Patent
Malaspina

(10) Patent No.: US 6,585,415 B2
(45) Date of Patent: Jul. 1, 2003

(54) EXPENDABLE GARBAGE BAG

(75) Inventor: Alberto Malaspina, Ovada (IT)

(73) Assignee: Nuova Poliver di Oddone Colomba & C. S.n.c., Tagliolo Monferrato (IT)

( * ) Notice: Subject to any disclaimer, the term of this patent is extended or adjusted under 35 U.S.C. 154(b) by 0 days.

(21) Appl. No.: 10/092,610

(22) Filed: Mar. 8, 2002

(65) Prior Publication Data

US 2002/0191871 A1 Dec. 19, 2002

(30) Foreign Application Priority Data

Jun. 14, 2001 (IT) ..... TO2001U0095

(51) Int. Cl.[7] ..... B65D 33/28
(52) U.S. Cl. ..... 383/75; 383/43
(58) Field of Search ..... 383/75, 43

(56) References Cited

U.S. PATENT DOCUMENTS 4,786,189 A * 11/1988 Broderick et al. ..... 383/75
5,133,607 A * 7/1992 Bonke ..... 383/75
5,232,118 A * 8/1993 Samuel ..... 220/495.11
5,374,232 A * 12/1994 Cipollone ..... 493/194
6,059,458 A * 5/2000 Belias et al. ..... 383/75
6,164,824 A * 12/2000 McGlew et al. ..... 383/75

* cited by examiner

*Primary Examiner*—Jes F. Pascua
(74) *Attorney, Agent, or Firm*—Guido Modiano; Albert Josif; Daniel O'Byrne

(57) ABSTRACT

The bag is made from a polyethylene sheet and has a mouth with at least one sheath along its edge, the sheath containing an inextensible ribbon which is graspable from outside through a hole cut in the sheath, in order to close the bag after filling. An elastically extensible ribbon is fastened at its opposite ends to the material of the bag. When the bag is received in a rigid bin with its upper margin overturned over the bin rim, the elastic ribbon is pulled radially, looped and released around the overturn of the bag to clamp it around the bin.

8 Claims, 4 Drawing Sheets

EXPENDABLE GARBAGE BAG

BACKGROUND OF THE INVENTION

This invention is concerned with an expendable garbage-bag made of a synthetic material such as polyethylene, and is more particularly concerned with a bag provided with attached fastening ties comprising ribbons which are received in a sheath formed at the upper edge of the bag, and can be partly pulled out through a hole cut in the sheath.

Such garbage-bags are widely used in association with bins placed along city streets and courts, or in offices, workshops, laboratories, as well as in communities, including hospitals and first-aid stations. The bag is inserted into the bin from above while stretching the material of the bag against the wall of the bin to form a lining. The upper edge of the bag is then folded over the rim of the bin, so that the bag stays open to receive articles thrown into it, in the expectation that the volume of garbage building up in the bag will stabilize it to its open condition. When the bag is full, the ribbons are partly pulled through their respective holes to crimp the sheaths and shrink the bag mouth, and the ribbons are then bound together to close the bag, which can be collected later by the refuse collection services.

However, it often happens that the bag, which is precariously placed in the bin, will not meet the expectations, since the fold over the bin rim, which is supposed to keep it in the proper condition, will often slip under the weight of the litter, so that the bag will sink and the opposite margins will collapse against each other. As a consequence, matter thrown into the bin will partly fall outside the bag. This causes untidiness and dirtiness, as well as a supplementary and unpleasant workload for the workers who then have to clean up, and, particularly in the case of hospitals, it may also give rise to a danger of spreading of infections.

The circumstances are even worse if the bins do not have a solid wall, e.g. if they are made from wire nets or from resin cages; in this case there is the risk that residues comprising fine particles, after being thrown into the bin outside the bag, will fall to ground.

SUMMARY OF THE INVENTION

A main object of this invention is therefore to provide a garbage bag for installation in rigid bins, which can be quickly and stably attached in position with an open mouth and which can be quickly pulled out and tied.

Another object of the invention is to provide such bag by using substantially known processes and equipment, i.e. without requiring substantial structural changes to the manufacturing equipment.

A further object of the invention is to provide such improved bag with manufacturing costs that are substantially the same as for the conventional bag provided with sheath-enclosed tiestrings.

The invention achieves the above objects, as well as other objects and advantages that will appear from the following disclosure, by providing a garbage bag having the features set out in claim 1.

BRIEF DESCRIPTION OF THE DRAWINGS

The invention will now be described in more detail with reference to preferred but not exclusive embodiments, which are shown by way of nonlimiting example on the attached drawings, wherein.

Figure 1:
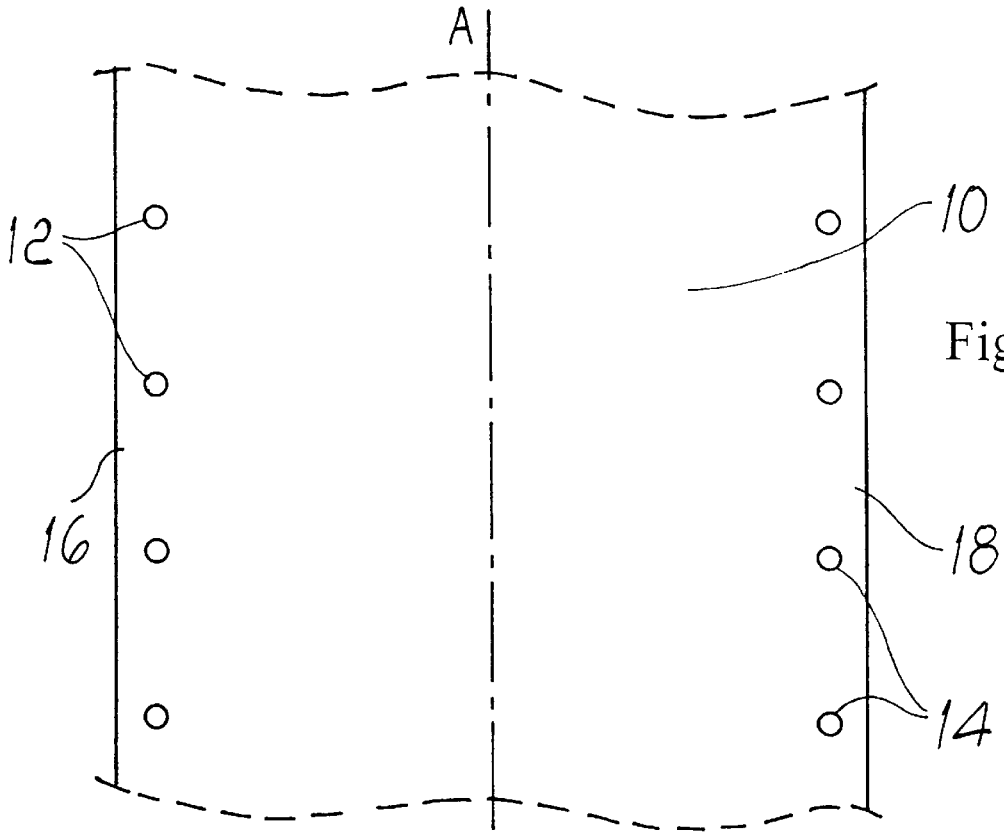
FIG. 1 is a diagrammatical plan view of a piece of trip-like polyethylene sheet used for manufacturing garbage bags according to the invention.

It should be noted that the different parts in the drawings are not all to the same scale, for better clarity of illustration.

DESCRIPTION OF THE PREFERRED EMBODIMENTS

As well known to the person skilled in the art, and with reference to FIGS. 1 to 5, an expendable garbage bag of the kind considered herein is usually made in large numbers on a conventional, continuous manufacturing line, by the following process. A strip-like polyethylene sheet 10, which is folded along its median line A, is punched with spaced holes such as 12, 14, at a short distance from its opposite longitudinal sides (FIG. 1). Side edges 16 and 18 are then progressively folded, while respective, continuous, inextensible ribbons 20 and 22, which are also made of polyethylene, are inserted within the folds. The folded edges of the strip are then welded to each other in 17, 19 (FIG. 2) to form continuous sheaths 16, 18, in which said ribbons 20 and 22 are received.

Figure 2:
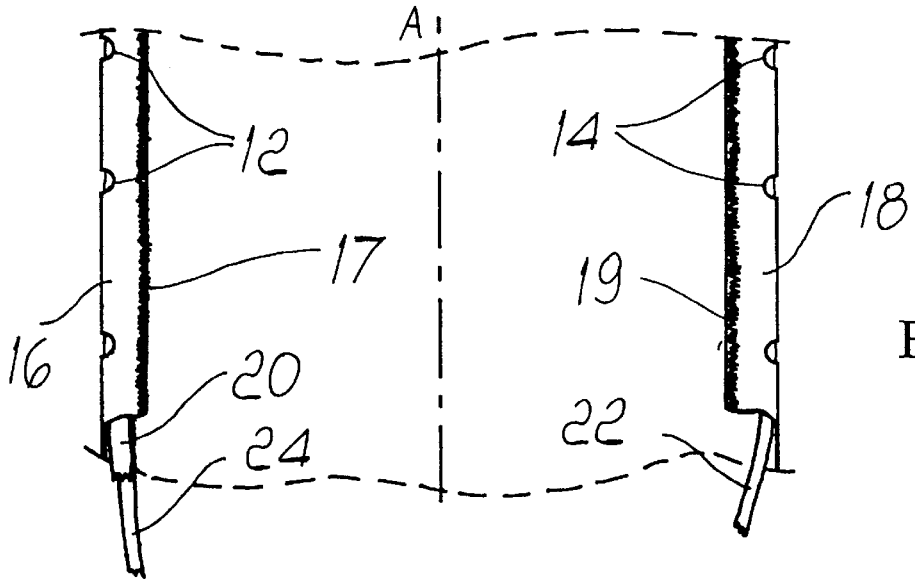
FIG. 2 is a view of the sheet of FIG. 1, during formation of side sheaths, in preparation to completing the bag.

According to the invention, and as shown on FIG. 2, when inserting an inextensible ribbon 20 into sheath 16, also a further ribbon 24 is inserted, which, however, is made of elastically extensible polyethylene.

Figure 3:
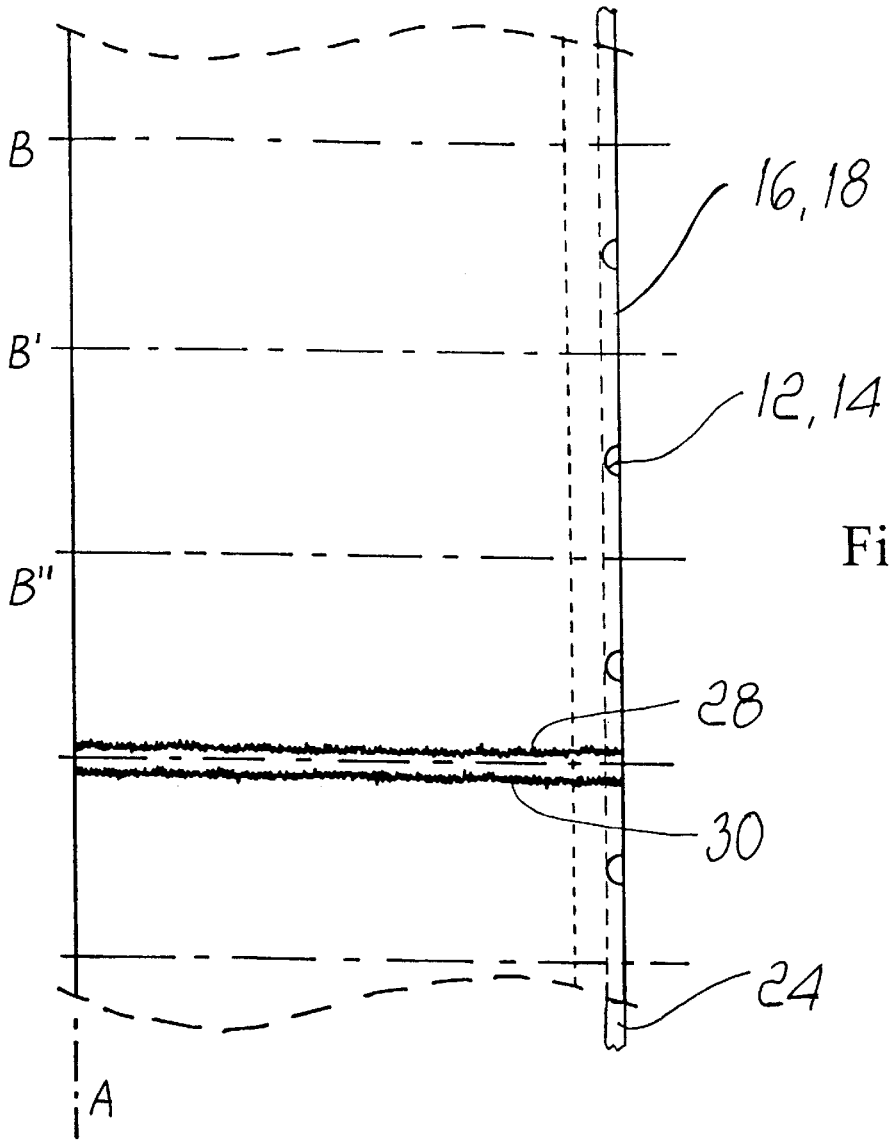
FIG. 3 is a diagrammatical plan view of the sheet of FIGS. 1 to 3, to a slightly enlarged scale, after lengthwise folding, in a subsequent manufacturing step.
Figure 4:
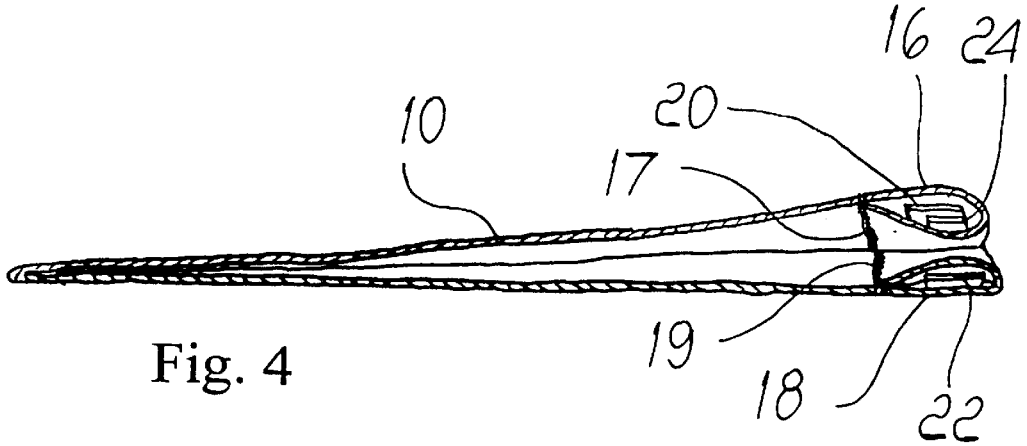
FIG. 4 is a view in longitudinal cross-section of a bag according to the invention, to an enlarged scale.

FIG. 3 shows how polyethylene sheet 10, longitudinally folded around median line A, is then divided into a number of compartments by means of double, transverse hot welds such as 28, 30, along transverse lines B, B', B", . . . , which are spaced among holes 12, 14. Subsequently, or during welding, cuts are made along lines B, B', B", so that bags are formed, each having a mouth provided with two sheaths 16, 18, which contain respective inextensible ribbons 20, 22, for tying the bag after filling, and wherein, according to the invention, sheath 16 also contains an elastic ribbon 24. Both ribbons 20, 22 and the elastic ribbon 24 have their opposite ends fastened to the ends of the respective sheaths by effect of said transverse welds. The structure of the completed bag is shown on FIG. 4.

Figure 5:
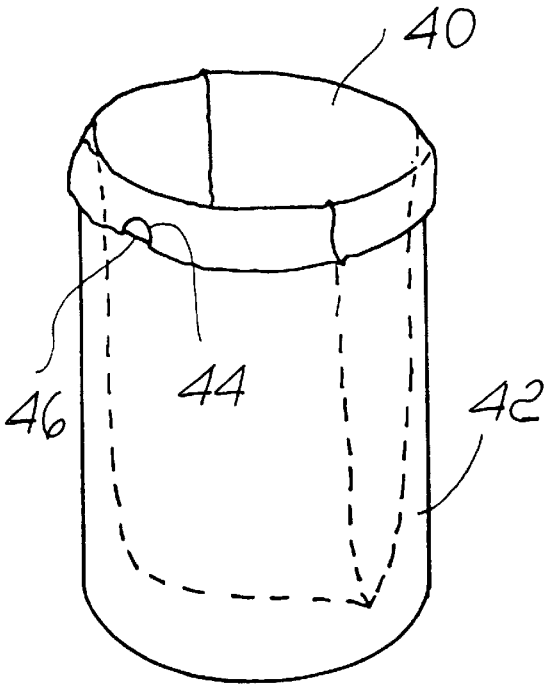
FIG. 5 is a view of a garbage bag according to the invention, in a first step of insertion into a bin.

FIG. 5 shows how a bag 40, manufactured as describe above, can be placed into a bin 42 while overturning its upper margin over the rim of the bin, the margin being provided with sheaths, among which sheath 44 containing elastic ribbon 46 which is accessible through a hole 48.

Figure 6:
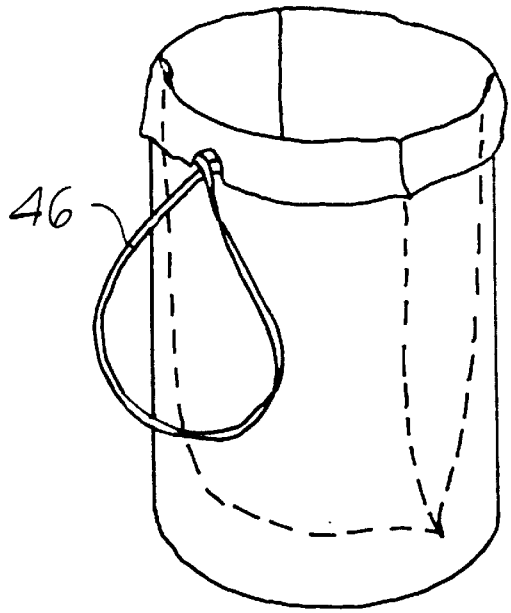
FIG. 6 is a view of a garbage bag according to the invention, in a second step of insertion into a bin.

FIG. 6 shows a subsequent step in the installation of the bag in the bin, whereby elastic ribbon 46 is pulled radially through hole 48, while elastically stretching it, and is then twisted to build a loop.

Figure 7:
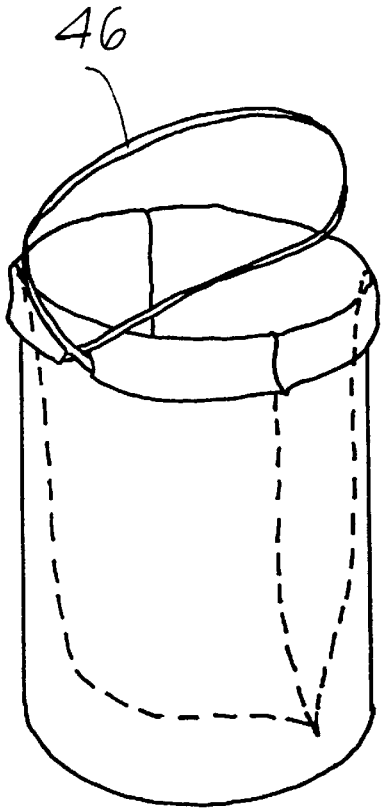
FIG. 7 is a view of a garbage bag according to the invention, in a final step of insertion into a bin.

FIG. 7 shows how the loop of elastic ribbon is overturned above the bin mouth. In the subsequent step (not shown), the elastic ribbon is released around the folded turn-down of the bag to tighten it around the underlying bin and firmly clasp the bag in the desired operating position.

When filled, the bag can be quickly released by releasing elastic ribbon 46. The inextensible ribbons (not visible on FIGS. 5 to 7) are then grasped and pulled through hole 44 and the hole in the second sheath of the bag (also not visible on FIGS. 5 to 7) to crimp both sheaths. The ribbons are then tied together.

For ease of use, the inextensible ribbons are made of a material of a first color, say yellow, while the material of the elastic ribbon is of a second, contrasting color, say red.

The elastically extensible ribbon is preferably also made of polyethylene, which, however, must be a mix having a high degree of elastic stretch. The degree of elastic stretch should be higher than 200%, say about 250%, and preferably 300% or more, without reaching the yield point, so that the elastic springback of the ribbon will tighten the overturn of the bag around the bin, as taught above.

It should be evident that the additional cost of the bag as above described, with respect to a conventional bag of the same type is substantially limited to the mere buying cost of the elastic ribbon, which is slight with respect to the overall cost of the bag, while the additional manufacturing cost may be regarded as negligible, as will be apparent to a person skilled in the art, because the elastic ribbon is fed to the manufacturing line together with the inextensible ribbon which is received in the same sheath, without any substantial changes to the operation.

Figure 8:
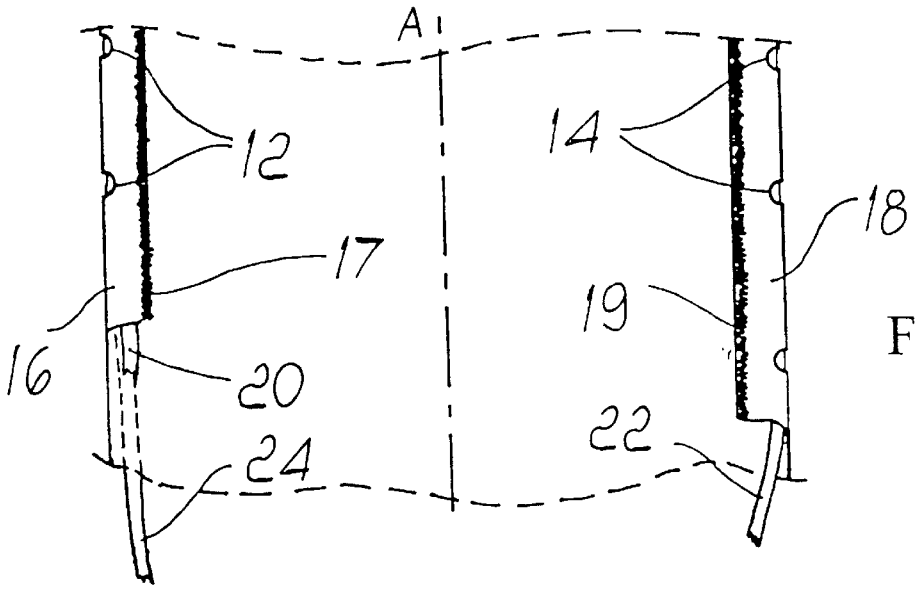
FIGS. 8, 9 and 10 are similar to FIGS. 2, 3 and 4, but they show a different embodiment of the garbage bag according to the invention.
Figure 9:
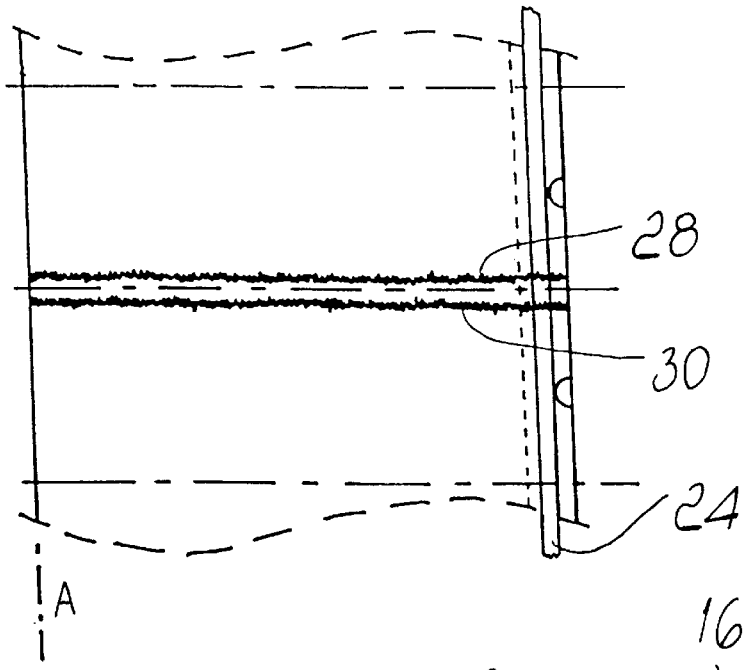
Figure 10:
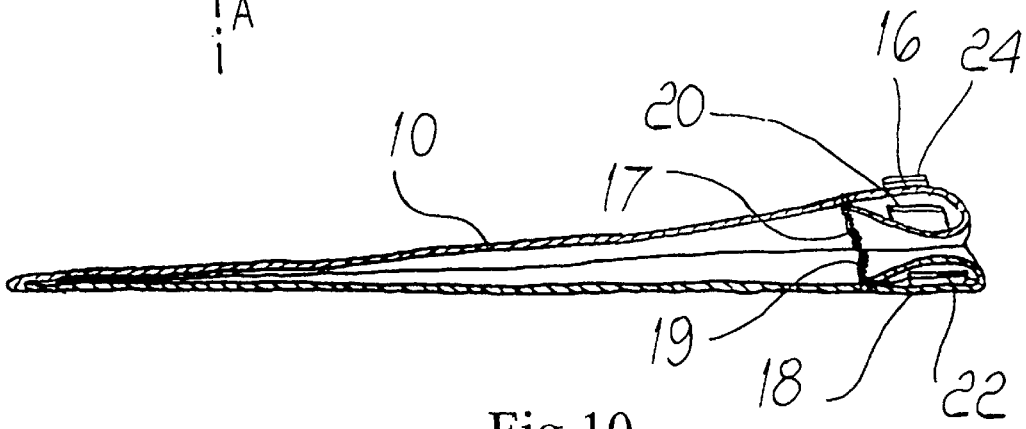

According to another embodiment of the garbage bag of the invention, shown on FIGS. 8, 9 and 10, elastic ribbon 24 is welded externally to sheath 16 on the outside of the bag. Even in this case, elastic ribbon 24 has its opposite ends fastened to the ends of the respective sheaths, though to their outsides. With this embodiment, when the upper margin of the bag is overturned over the bin rim in the first operational step, elastic ribbon 46 will be hidden under the sheath. However, it can still be extracted, twisted and released around the bin as in the first embodiment.

According to a further embodiment, not shown on the Figures, the elastic ribbon is inserted in one of the two sheaths in replacement of (rather than in addition to) the inextensible ribbon of the conventional bag. At the time of tying, the inextensible ribbon and the elastic ribbon can then be tied together, the inextensible ribbon being sufficient to sustain the weight of the bag.

Obviously, still further changes may be made to the preferred embodiments described above, which will be obvious for a person skilled in the art. In particular, the materials may change, provided that they are compatible with their use, as well as the dimensions and shapes of the bag and its parts.

The disclosures in Italian Utility Model Application No. TO2001U000095 from which this application claims priority are incorporated herein by reference.

What is claimed is:

1. A garbage bag made from a sheet of a synthetic material, having a mouth with at least one sheath along its edge, the sheath containing an inextensible ribbon which is graspable from outside through a hole cut in the sheath, further comprising at least one elastically extensible ribbon, which is fastened with its opposite ends to the material of the bag, substantially transversely to the bag near its mouth.

2. The garbage bag of claim 1, the bag being made from a folded polyethylene sheet in which both upper edges are folded over and welded to build two of said sheaths, an inextensible ribbon being received in each of said sheaths, wherein said elastically extensible ribbon is also received in one of said sheaths and is also graspable through said hole.

3. The garbage bag of claim 1, wherein the inextensible ribbons and the elastic ribbon are colored in contrasting, coded colors.

4. The garbage bag of claim 1, wherein the elastic ribbon is applied along said sheath externally to the bag.

5. The garbage bag of claim 1, wherein the bag as well as the inextensible ribbons and the elastic ribbon are of a polyethylene material, the material of the elastic ribbon having a high elastic deformability.

6. The garbage bag of claim 1, wherein the bag is made from a folded polyethylene sheet, its side edges adjacent to the fold being bonded by respective welds, wherein the opposite ends of the inextensible ribbons and of the elastic ribbon are bonded to the bag material by the same welds bonding said edges.

7. The garbage bag of claim 1, wherein the elastically extensible ribbon has an elastic stretch greater than 200%.

8. The garbage bag of claim 7, wherein the elastically extensible ribbon has an elastic stretch larger of about 250%.

* * * * *